US010150295B2

(12) United States Patent
Kudo et al.

(10) Patent No.: US 10,150,295 B2
(45) Date of Patent: Dec. 11, 2018

(54) LIQUID EJECTION HEAD AND METHOD FOR MANUFACTURING THE SAME

(71) Applicant: CANON KABUSHIKI KAISHA, Tokyo (JP)

(72) Inventors: Tokuji Kudo, Kawasaki (JP); Chiaki Muraoka, Kawaguchi (JP); Shimpei Yoshikawa, Yokohama (JP); Yuichiro Akama, Tokyo (JP); Yuji Tamaru, Yokohama (JP); Yosuke Takagi, Yokohama (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/397,229

(22) Filed: Jan. 3, 2017

(65) Prior Publication Data

US 2017/0190176 A1 Jul. 6, 2017

(30) Foreign Application Priority Data

Jan. 6, 2016 (JP) ..... 2016-000964

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2002/14491; B41J 2/14072
See application file for complete search history.

(56) References Cited

U.S. PATENT DOCUMENTS 8,833,889 B2 * 9/2014 Kanno ..... B41J 2/04508 347/9
2002/0071004 A1 * 6/2002 Kaneko ..... B41J 2/14024 347/58
2003/0090547 A1 * 5/2003 Imanaka ..... B41J 2/14072 347/59
2008/0074473 A1 * 3/2008 Takabe ..... B41J 2/14233 347/70
2009/0015639 A1 * 1/2009 Fukui ..... B41J 2/04528 347/62
2012/0047737 A1 * 3/2012 Ishida ..... B41J 2/1404 29/890.1
2015/0171307 A1 * 6/2015 Masuda ..... H01L 41/0533 347/71
2016/0257151 A1 * 9/2016 Kanno ..... B41J 29/393

FOREIGN PATENT DOCUMENTS

JP 2003-145770 A 5/2003

* cited by examiner

*Primary Examiner* — John P Zimmermann
(74) *Attorney, Agent, or Firm* — Canon U.S.A., Inc. IP Division

(57) ABSTRACT

A liquid ejection head includes an energy generating element configured to generate energy used for ejection of a liquid, a print element board including an electroconductive anti-cavitation film provided to cover the energy generating element, and a connection board electrically connected to the anti-cavitation film and including a connection pad electrically connectable from outside.

15 Claims, 8 Drawing Sheets

LIQUID EJECTION HEAD AND METHOD FOR MANUFACTURING THE SAME

BACKGROUND

Field of the Disclosure

The present disclosure relates to a liquid ejection head and a method for manufacturing the same.

Description of the Related Art

As a liquid ejection head which ejects a liquid such as ink from an ejection port, a liquid ejection head which ejects a liquid using thermal energy is proposed. The liquid ejection head of this type includes an energy generating element which generates thermal energy in accordance with an electrical signal. The thermal energy causes air bubbles to be generated in the liquid, and the liquid is ejected using the air bubbles. In such a liquid ejection head, a mechanical impact (i.e., cavitation) occurs during growth and disappearance of air bubbles when the liquid is ejected. In order to protect the energy generating element from cavitation, forming an anti-cavitation film to cover the energy generating element is proposed.

In many cases, the anti-cavitation film is formed of an electroconductive metallic material from the viewpoint of intensity. If conduction is established between an electroconductive anti-cavitation film and other electrical wirings and a potential is generated, a charge transfers to the liquid and properties of the anti-cavitation film may be changed (i.e., anodized). As a result, a function as the anti-cavitation film may be impaired. It is therefore important that the anti-cavitation film is insulated from other electrical wirings with an insulating film.

Japanese Patent Laid-Open No. 2003-145770 discloses a method for performing an electric inspection as to whether insulation between an anti-cavitation film and other electrical wirings has been established by applying a voltage to a test pad connected to the anti-cavitation film.

The above disclosed electric inspection is based on the premise that it is performed before a liquid ejection head is completed in a manufacturing process of the liquid ejection head. Specifically, the electric inspection is performed when a print element board is formed with an anti-cavitation film etc. formed on a substrate (wafer). However, even after the electric inspection is performed, the print element board is subject to many processes, such as a wiring process and an assembly process, until the liquid ejection head is completed. Therefore, static electricity may be applied to the print element board or external force may act on the print element board, which may cause conduction to be established between the anti-cavitation film and other electrical wirings. Since the liquid ejection head is used with a liquid filled therewith, it is required to inspect existence of conduction between the anti-cavitation film and other electrical wirings also in a condition in which the liquid ejection head is filled with a liquid. In order to reliably establish insulation of the anti-cavitation film, it is required to perform the electric inspection of the anti-cavitation film in the final form in which the liquid ejection head is completed.

SUMMARY

The present disclosure provides a liquid ejection head capable of performing an electric inspection of insulation between an anti-cavitation film and other electrical wirings in the final form, and a method for manufacturing the liquid ejection head.

In an aspect of the present disclosure, a liquid ejection head includes an energy generating element configured to generate energy used for ejection of a liquid, a print element board including an electroconductive anti-cavitation film provided to cover the energy generating element, and a connection board electrically connected to the anti-cavitation film, and including a connection pad electrically connectable from outside.

In an aspect of the present disclosure, a method for manufacturing a liquid ejection head includes steps of preparing a print element board which includes an energy generating element configured to generate energy used for ejection of a liquid, an electroconductive anti-cavitation film provided to cover the energy generating element, and an electrical wiring electrically connected with the energy generating element, preparing a connection board which includes a connection pad electrically connectable from the outside, electrically connecting the connection pad and the anti-cavitation film, and inspecting insulation between the anti-cavitation film and other electrical wirings through the connection pad.

Further features of the present disclosure will become apparent from the following description of exemplary embodiments with reference to the attached drawings.

DESCRIPTION OF THE EMBODIMENTS

Hereinafter, an embodiment of the present disclosure will be described with reference to the drawings.

Figure 1:
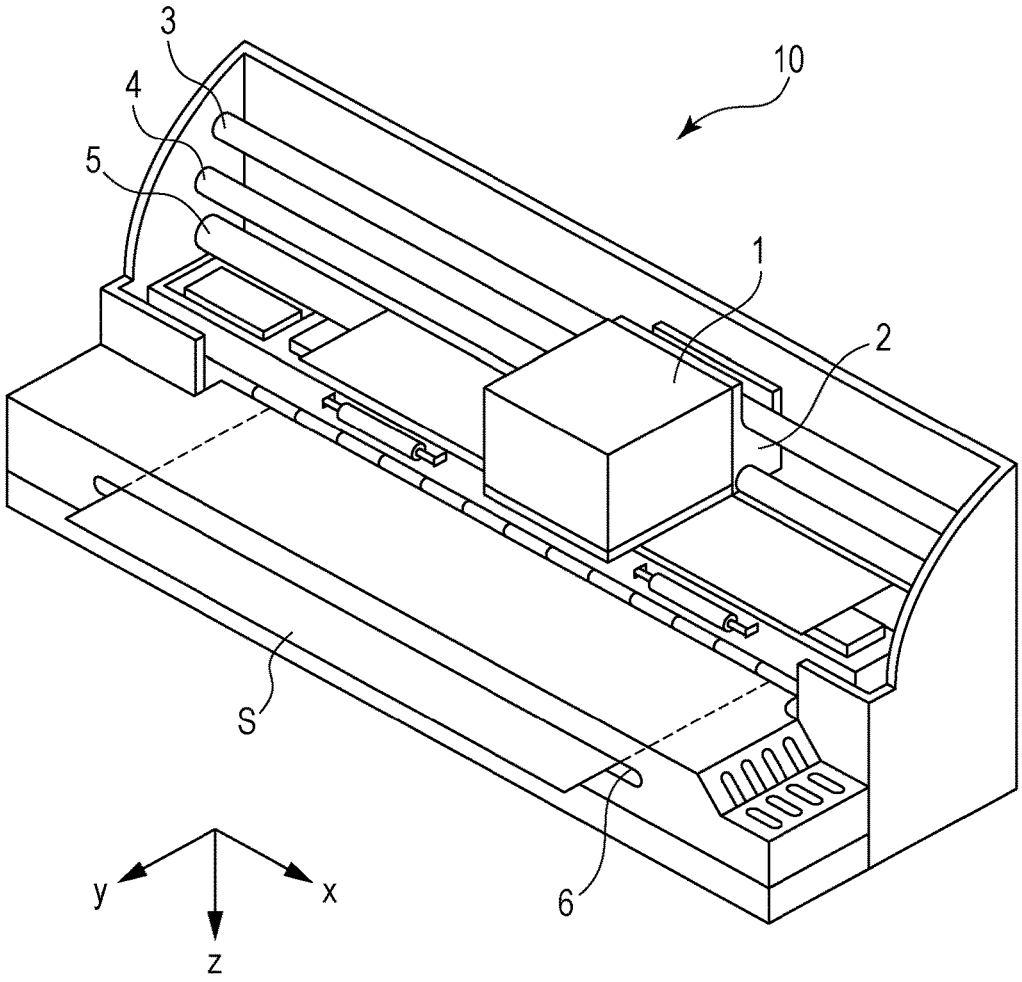
FIG. 1 is a schematic perspective view of an internal configuration of a liquid ejection apparatus.

FIG. 1 is a schematic perspective view of an internal configuration of a liquid ejection apparatus on which a liquid ejection head according to an embodiment of the present disclosure is mounted.

A liquid ejection apparatus 10 is a serial scanning liquid ejection apparatus and includes a liquid ejection head 1 and a carriage 2 on which the liquid ejection head 1 is mounted. The liquid ejection head 1 is formed on a surface facing a sheet S, and includes plural ejection ports (not illustrated) for ejecting a liquid toward the sheet S in a z direction in FIG. 1. The carriage 2 is supported by guide shafts 3 and 4 to be reciprocable in a main scanning direction (an x direction in FIG. 1). In the liquid ejection apparatus 10, the sheet S is inserted in an insertion port 6 provided in the liquid ejection apparatus 10, a traveling direction of the sheet S is inverted, and the sheet S is conveyed with a roller 5 in a sub-scanning direction (a y direction in FIG. 1). By repeating a recording operation in which a liquid is ejected from the liquid ejection head 1 and a conveyance operation of the sheet S with the roller 5 while the carriage 2 is moving, an image is recorded on the sheet S.

The liquid ejection head 1 of the present embodiment includes an energy generating element which generates thermal energy used for the ejection of the liquid as described below. Air bubbles are generated in the liquid by the thermal energy, and the liquid is ejected from the ejection ports using the air bubbles.

Figure 2:
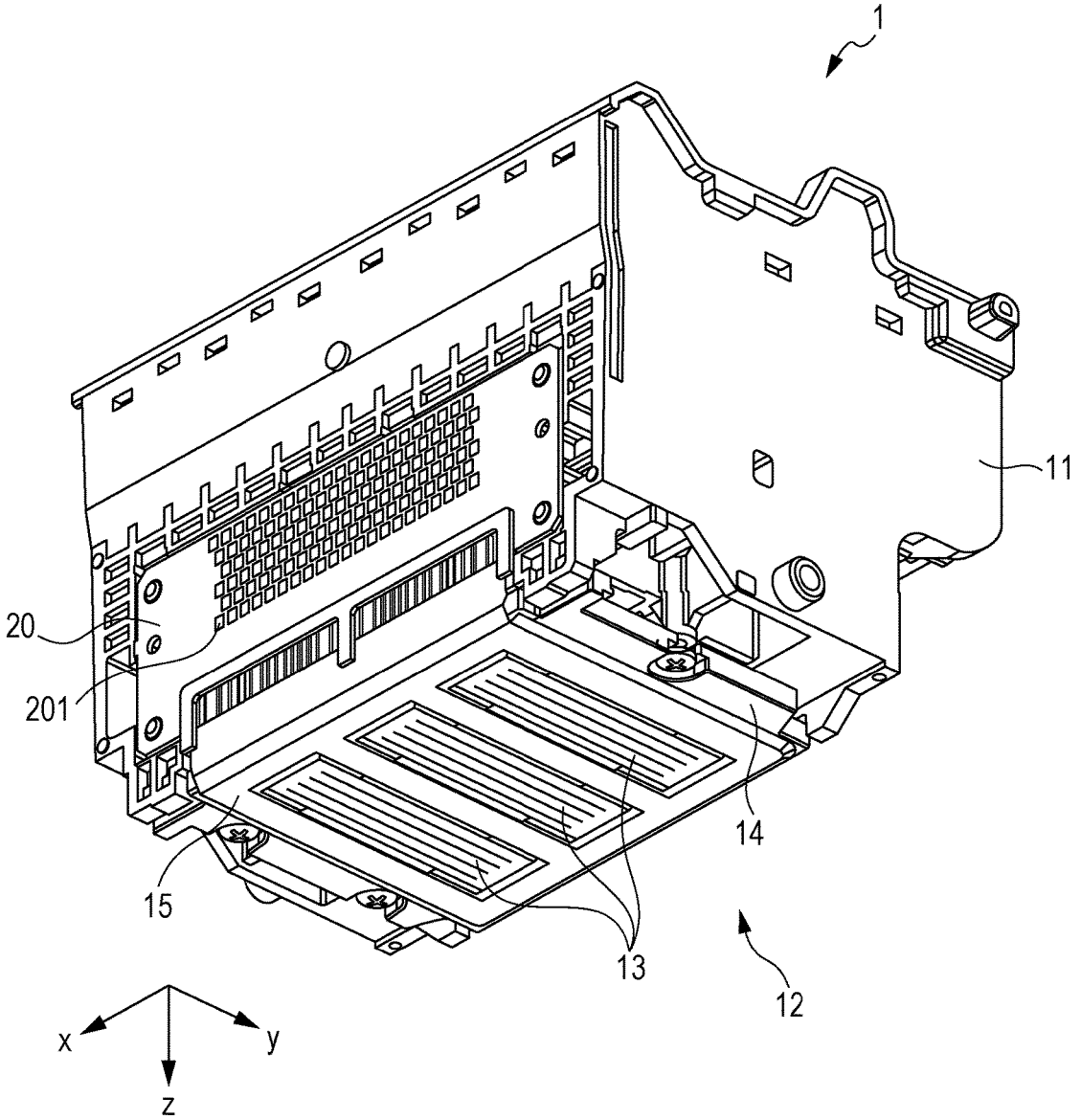
FIG. 2 is a perspective view of a configuration of a liquid ejection head.

FIG. 2 is a perspective view of a configuration of the liquid ejection head 1 of the present embodiment.

The liquid ejection head 1 includes a housing 11, a print element board unit 12, a wiring member 15, and a connection board 20. The print element board unit 12, the wiring member 15, and the connection board 20 are fixed to the housing 11. A liquid reservoir (not illustrated) which contains a liquid is mounted on the housing 11. A flow path for supplying the liquid to the print element board unit 12 from the liquid reservoir is provided inside the housing 11.

The print element board unit 12 includes print element boards 13 and a support member 14 which supports the print element boards 13. Although three print element boards 13 are provided in the illustrated example, the number of the print element boards is not limited to three. Each print element board 13 includes a substrate in which the energy generating element is provided, and a flow path forming member which is joined to the substrate and in which plural ejection ports and plural flow paths are formed. The energy generating element is disposed to face the ejection ports. A supply path which supplies the liquid supplied from the liquid reservoir of the housing 11 to plural flow paths is formed in the substrate. Although four ejection port arrays are formed for each print element board 13 so that different types of liquids can be ejected from each of the ejection port arrays in the illustrated example, the number of ejection port arrays is not limited to four.

The connection board 20 is a member for electrically connecting the liquid ejection head 1 and an apparatus main body of the liquid ejection apparatus 10. The wiring member 15 is a member for electrically connecting the connection board 20 and the print element boards 13. That is, an electrical signal for the ejection of the liquid is input from the apparatus main body of the liquid ejection apparatus 10, and is supplied to the print element boards 13 via the connection board 20 and the wiring member 15. Rectangular openings are formed in the wiring member 15 at positions corresponding to positions where the print element boards 13 are disposed. Terminal portions which are electrically connected to electrode portions of the print element boards 13 are provided on peripheral edges of short sides of the openings. The wiring member 15 also includes a terminal portion which is electrically connected to connection pads 201 of the connection board 20. A flexible wiring substrate etc. can be used as the wiring member 15.

Figure 3A:
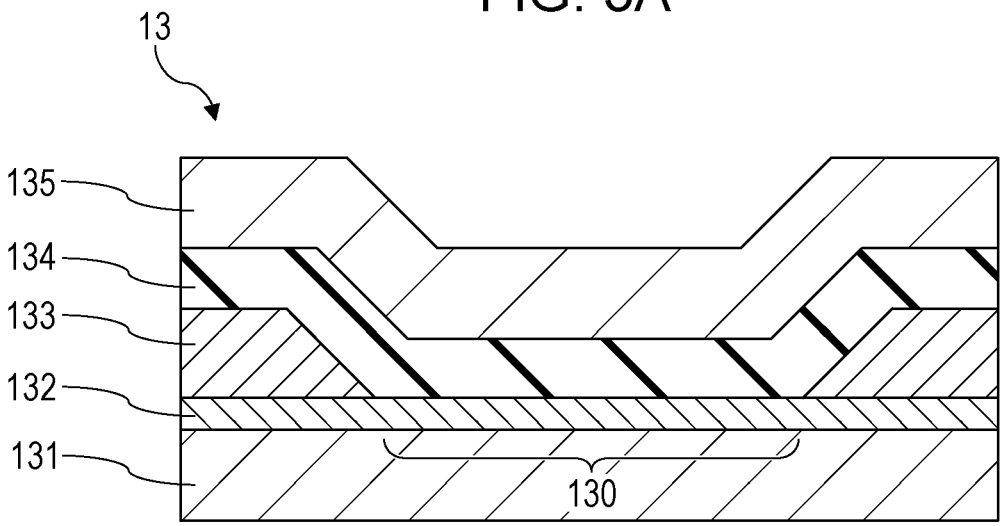
FIGS. 3A and 3B are schematic cross-sectional views of an exemplary configuration of a print element board.
Figure 3B:
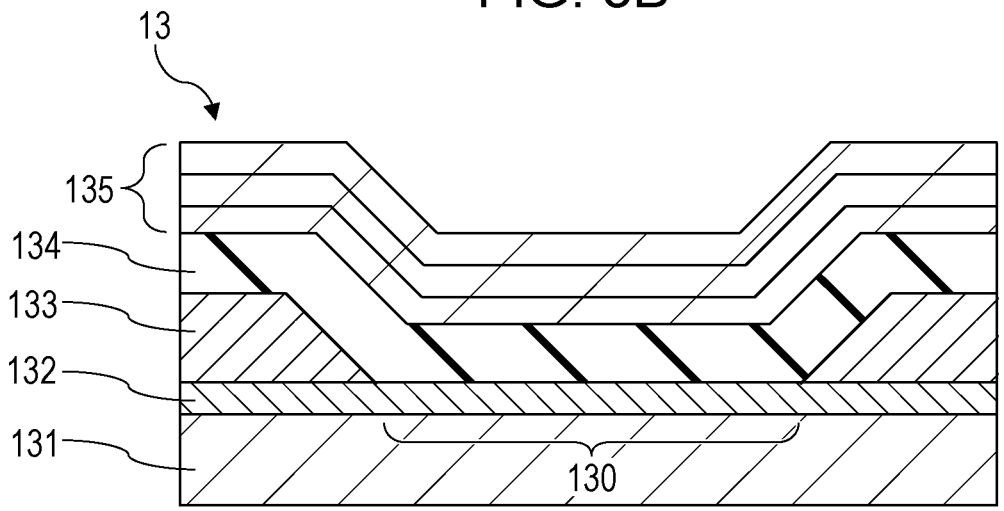

FIG. 3A is a schematic cross-sectional view of one exemplary configuration, and FIG. 3B is a schematic cross-sectional view of another exemplary configuration of the print element board of the present embodiment.

Each print element board 13 includes a substrate 131 formed of Si, a heat generating resistive element layer 132 formed on the substrate 131 and formed of Al, for example, and a pair of wiring layers 133 formed on the heat generating resistive element layer 132 and formed of Al, for example. A portion of the heat generating resistive element layer 132 located between the pair of wiring layers 133 functions as the energy generating element 130 and, when a voltage is applied to the pair of wiring layers 133, the heat generating resistive element layer 132 is heated and can generate thermal energy. With this thermal energy, air bubbles are generated in the liquid in the flow path, and a liquid can be ejected from the ejection ports using the air bubbles.

An anti-cavitation film 135 is formed above the heat generating resistive element layer 132 and the pair of wiring layers 133 to protect the energy generating element 130 from a mechanical impact (i.e., cavitation) which occurs during growth and disappearance of the air bubbles when the liquid is ejected. The anti-cavitation film 135 is desirably formed of an electroconductive metallic material from the viewpoint of intensity, and is especially desirably formed of Ta. The anti-cavitation film 135 may have a single layer structure of Ta as illustrated in FIG. 3A, or may have a 3-layer structure of Ta/Ir/Ta as illustrated in FIG. 3B. An insulating film 134 is formed between the anti-cavitation film 135 and the heat generating resistive element layer 132 and between the anti-cavitation film 135 and the pair of wiring layers 133 for the insulation of these films and layers.

If conduction is established between the anti-cavitation film 135 and the heat generating resistive element layer 132 or the wiring layers 133 while the anti-cavitation film 135 is in contact with the liquid in the flow path, a charge transfers from the anti-cavitation film 135 to the liquid and the anti-cavitation film 135 is anodized. As a result, resistance to cavitation of the anti-cavitation film 135 is lowered and liquid ejection performance is decreased significantly. Therefore, in order to reduce a decrease in liquid ejection performance and to maintain quality of a recorded image favorable, it is important that insulation between the anti-cavitation film 135 and the heat generating resistive element layer 132, and between the anti-cavitation film 135 and the wiring layers 133 is guaranteed especially in the final form of the liquid ejection head 1. Then, the liquid ejection head 1 of the present embodiment has a configuration capable of performing an electric inspection to inspect existence of conduction between the anti-cavitation film 135 and other electrical wirings (especially the wiring layers 133) as described below.

Figure 4:
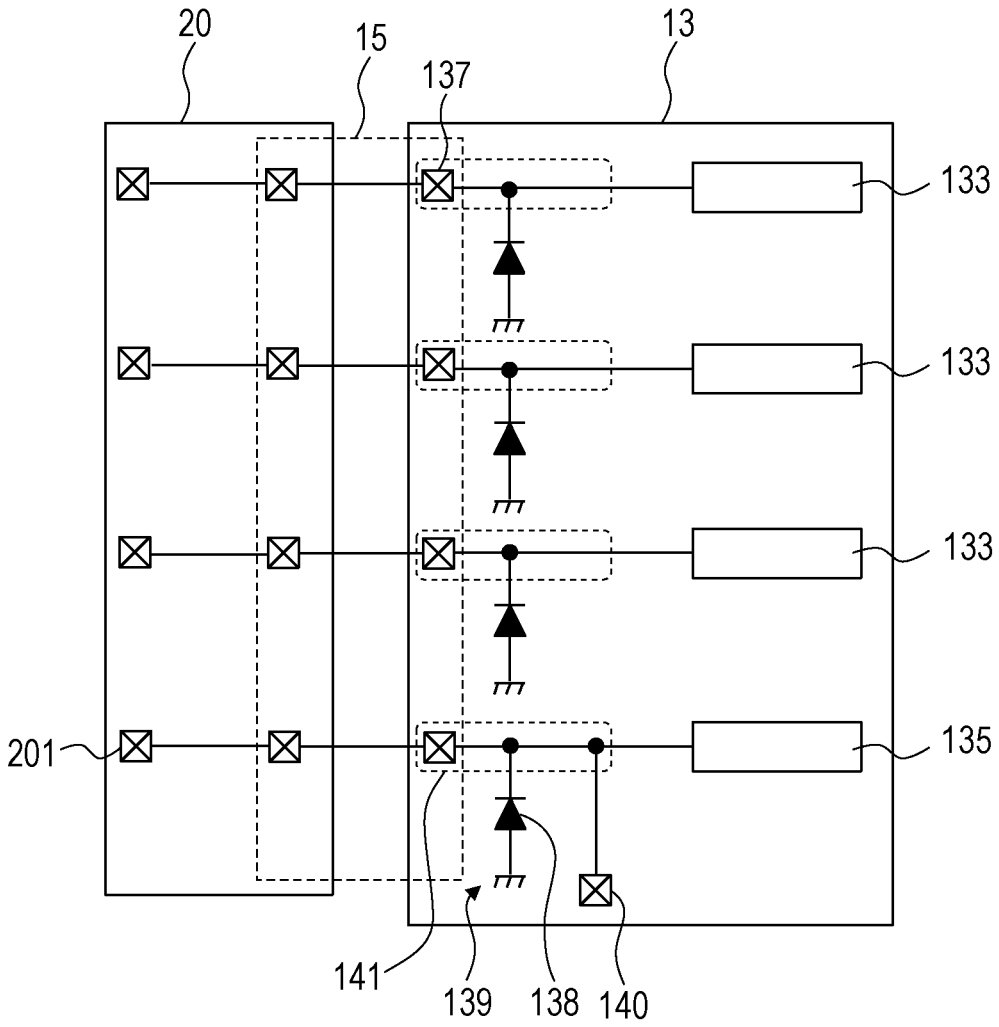
FIG. 4 is a block diagram of a schematic circuit configuration of the liquid ejection head in the final form.
Figure 5:
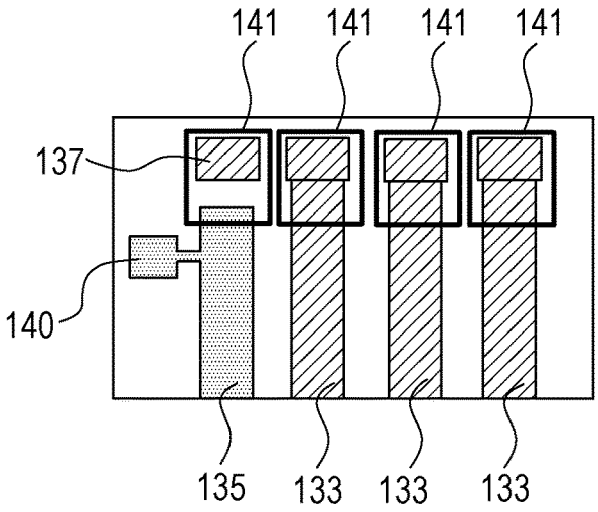
FIG. 5 is a schematic plan view corresponding to the circuit configuration of a print element board illustrated in FIG. 4.

FIG. 4 is a block diagram of a schematic circuit configuration of the print element board 13, the wiring member 15, and the connection board 20 in the final form of the liquid ejection head 1 of the present embodiment. FIG. 5 is a schematic plan view corresponding to the circuit configuration of the print element board 13 illustrated in FIG. 4.

The anti-cavitation film 135 is electrically connected to an electrode portion 141 of the print element board 13, and the electrode portion 141 is electrically connected to the connection pad 201 of the connection board 20 via the wiring member 15. The connection pad 201 is connectable from the outside of the liquid ejection head 1 (see FIG. 2) and, therefore, the connection pad 201 can be electrically connected to the anti-cavitation film 135 from the outside of the liquid ejection head 1. Similarly, each wiring layer 133 is electrically connected to the connection pad 201 of the connection board 20 via the wiring member 15. Therefore, in the final form of the liquid ejection head 1, an electric inspection to inspect existence of conduction can be performed between the connection pad 201 connected to the anti-cavitation film 135 and the connection pads 201 connected to the wiring layers 133.

A protective diode 138 for protecting a circuit element (not illustrated) on the print element board 13 from destruction caused by electrostatic discharge is provided between the anti-cavitation film 135 and the connection pad 201. An anode of the protective diode 138 is connected to the anti-cavitation film 135, and a cathode of the protective diode 138 is connected to a ground (VSS) terminal 139. Therefore, static electricity applied to the connection pad 201 of the connection board 20 can be discharged to the VSS terminal 139 via the protective diode 138. Therefore, the following phenomenon may be reduced: the applied static electricity discharges to the circuit element on the print element board 13 via the anti-cavitation film 135, and the circuit element is destroyed. The protective diode 138 is provided similarly between each of the wiring layers 133 and the connection pad 201.

A test pad 140 is further connected to the anti-cavitation film 135. As described below, the test pad 140 is used to inspect the insulation of the anti-cavitation film 135 when the print element board 13 is in a single state.

The electrode portion 141 of the print element board 13 is formed by gold-plating on an electrode terminal 137 as illustrated in FIG. 5. Gold-plating is performed to improve reliability of electrical connection between the print element board 13 and the wiring member 15 and, at the same time, to connect the anti-cavitation film 135 with the anode of the protective diode 138. That is, as described below, the anti-cavitation film 135 and the protective diode 138 are not connected when the print element board 13 is in a single state before assembly, and are connected when gold-plating is performed.

Figure 6:
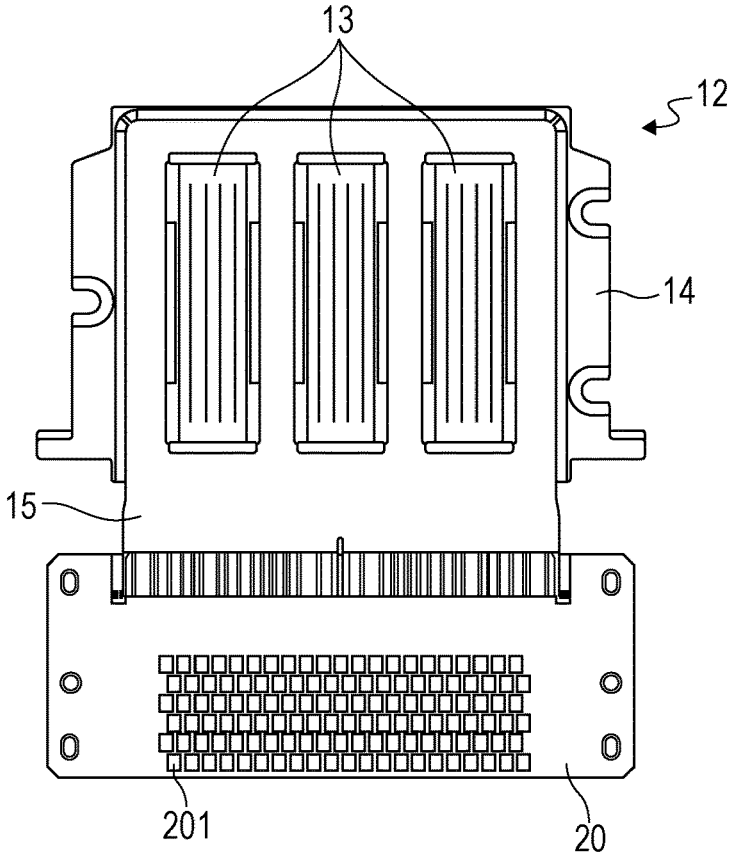
FIG. 6 is a schematic plan view of a print element board unit, a wiring member, and a connection board.

FIG. 6 is a schematic plan view of the print element board unit 12, the wiring member 15, and the connection board 20 of the present embodiment.

As described above, the print element board unit 12 includes the print element boards 13 and the support member 14 which supports the print element boards 13, and is electrically connected to the connection board 20 via the wiring member 15. The connection board 20 includes plural connection pads 201. The connection pads 201 are electrically connected to the anti-cavitation film 135, the wiring layers 133 used as power supply (VH) wiring for a heat generating resistive element (a heater) and a ground (GNDH) wiring, and a data (DATA) wiring for data signals, etc. Therefore, when the liquid ejection head 1 is mounted on the liquid ejection apparatus 10 and is driven, a driving signal for driving the liquid ejection head 1 and an electrical signal for ejecting the liquid are input from a connection terminal of the apparatus main body through the plural connection pads 201.

As described above, the connection pads 201 connected to the anti-cavitation film 135 are used for the inspection of the insulation of the anti-cavitation film 135, and not used when the liquid ejection head 1 is driven. Therefore, when the liquid ejection head 1 is mounted on the liquid ejection apparatus 10, it is not necessary that the connection pads 201 are electrically connected to the apparatus main body. However, if the insulation of the anti-cavitation film 135 is to be inspected in the liquid ejection apparatus 10, the connection pads 201 may be electrically connected to the apparatus main body.

Figure 7A:
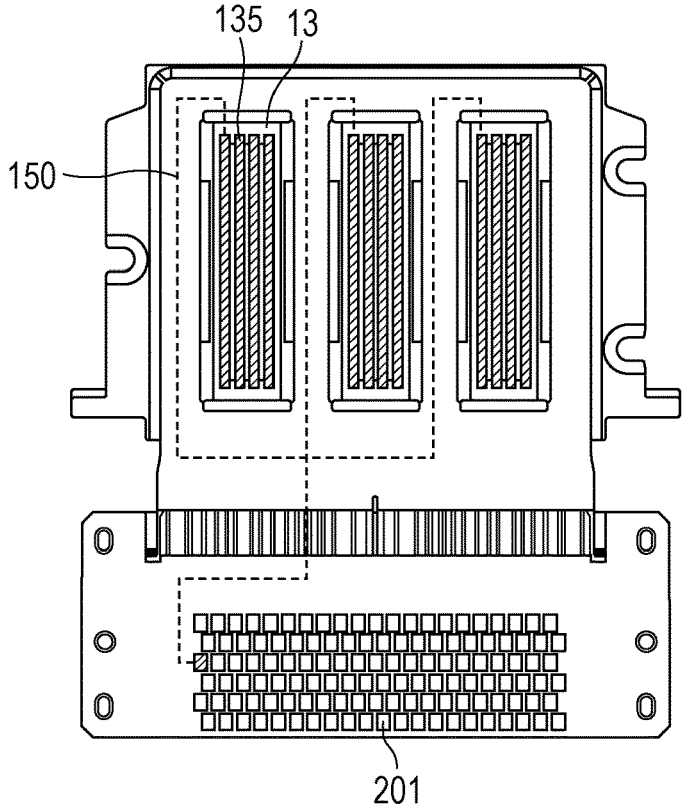
FIGS. 7A and 7B are perspective plan views of exemplary wiring of the print element board and the connection board.
Figure 7B:
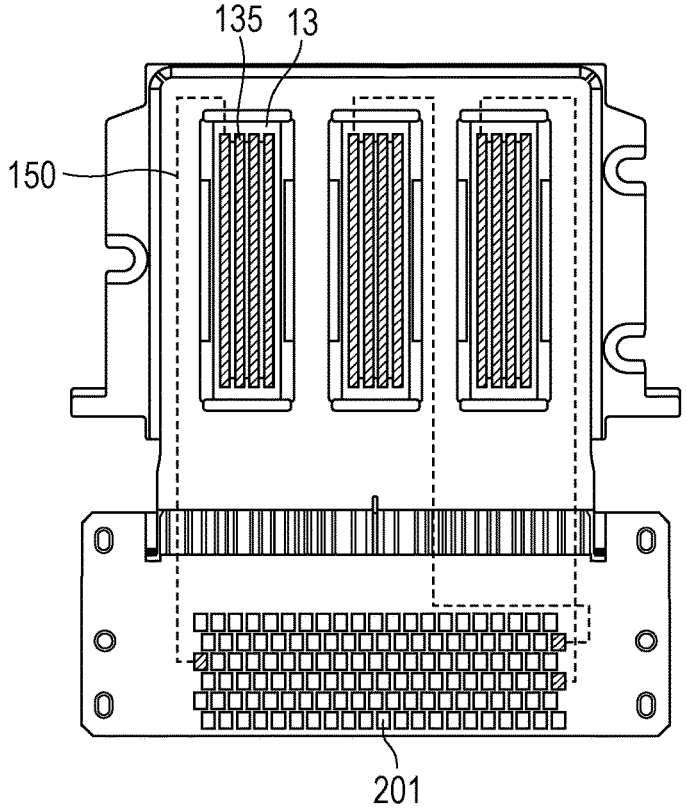

FIG. 7A is a perspective plan view of an example of wiring pattern of the print element boards 13 (the anti-cavitation film 135) and the connection board 20 (the connection pad 201) of the present embodiment, and FIG. 7B is a perspective plan view of another example.

The anti-cavitation film 135 is electrically connected to the connection pad 201 of the connection board 20 via a wiring 150 of the wiring member 15 connected to the electrode portion 141 of the print element board 13. In the wiring pattern illustrated in FIG. 7A, the wiring 150 of the wiring member 15 is formed so that plural anti-cavitation films 135 are connected to one connection pad 201. In this wiring configuration, when static electricity is applied to one connection pad 201 due to electrostatic discharge, the static electricity is distributed to the plural printing element boards 13 and is discharged to the ground through each of the protective diodes 138. That is, when electrostatic discharge occurs, the protective diode 138 formed separately in each print element board 13 can be made to function simultaneously, whereby resistance against destruction of the circuit element caused by electrostatic discharge can be increased.

The wiring pattern of the anti-cavitation film 135 and the connection pad 201 is not limited to that illustrated in FIG. 7A. For example, as illustrated in FIG. 7B, the wiring 150 of the wiring member 15 may be formed so that one anti-cavitation film 135 may be connected to one connection pad 201.

Next, with reference to a flowchart of FIG. 8, a method for manufacturing the liquid ejection head 1 of the present embodiment will be described.

Figure 9:
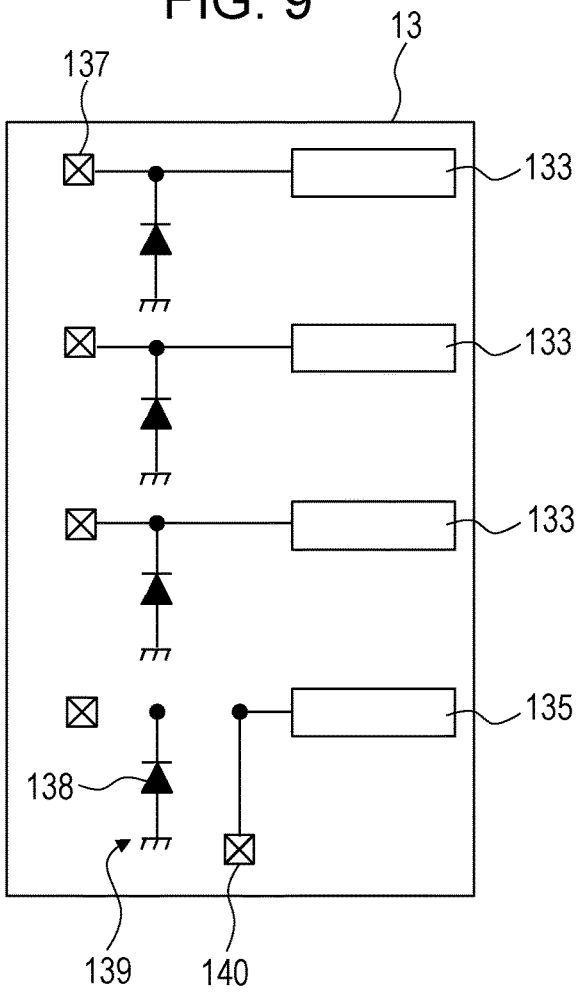
FIG. 9 is a block diagram of a schematic circuit configuration of a single print element board.
Figure 10:
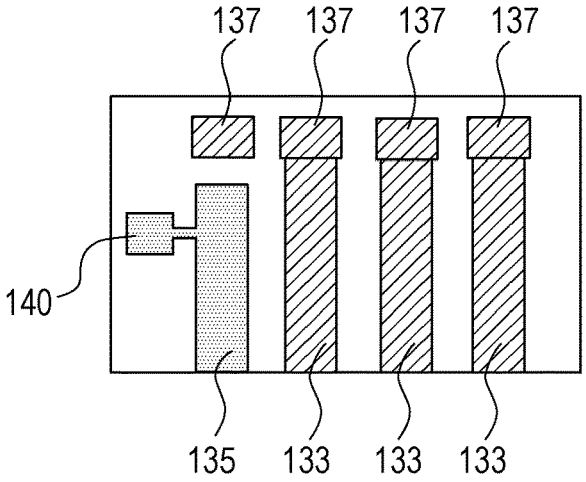
FIG. 10 is a schematic plan view corresponding to the circuit configuration of a print element board illustrated in FIG. 9.

First, the substrate (wafer) 131 is prepared and the heat generating resistive element layer 132, the wiring layers 133, the anti-cavitation film 135, the electrode terminal 137, the test pad 140, etc. are formed thereon. Plural print element boards 13 as illustrated in FIGS. 9 and 10 are formed (step S70). FIG. 9 is a block diagram of a schematic circuit configuration of the print element board 13, and FIG. 10 is a schematic plan view corresponding to FIG. 9. As illustrated in FIGS. 9 and 10, the wiring layer 133 formed of Al, for example, is formed so that conduction is established between the wiring layer 133 and the electrode terminal 137 which is formed also of Al, and the wiring layer 133 is connected to the protective diode 138 at the same time. The anti-cavitation film 135, formed of Ta, for example, is formed to be connected to the test pad 140, but conduction is not established between the anti-cavitation film 135 and the electrode terminal 137 nor between the anti-cavitation film 135 and the protective diode 138 because the anti-cavitation film 135 is formed as an uppermost layer on the substrate 131.

Next, an electric inspection of the print element board 13 is performed about each wiring (a VH wiring, a GNDH wiring, a DATA wiring, etc.) through the electrode terminal 137, and especially the heat generating resistive element layer 132 (a resistance value etc.) is checked (step S71). Then, an electric inspection of the anti-cavitation film 135 is performed (step S72).

Specifically, a voltage is applied to the test pad 140 connected to the anti-cavitation film 135, and whether insulation between the anti-cavitation film 135 and other electrical wirings (the wiring layers 133) is established is determined based on a measurement value of a leakage current. If the measurement value of the leakage current is equal to or greater than a threshold, it is determined that insulation is not established, and if the leakage current is smaller than the threshold, it is determined that insulation is established.

From the viewpoint of inspection efficiency, it is desirable that inspection of existence of the leakage current is collectively performed on other wiring layers 133. Therefore, a negative voltage is applied to the anti-cavitation film 135 (the test pad 140). When the anti-cavitation film 135 is connected to the protective diode 138, the leakage current flows into ground through the protective diode 138, and it becomes impossible to perform a correct electric inspection. For this reason, the anti-cavitation film 135 and the protective diode 138 are not connected when the print element board 13 is in a single state.

Next, the electrode terminal 137 is gold-plated and, as illustrated in FIGS. 4 and 5, the electrode portion (a plated layer) 141 is formed, and the anti-cavitation film 135 and the protective diode 138 are connected. Then the wafer is cut into plural printing element boards 13 (step S73). The liquid ejection head 1 is assembled (e.g., the print element board unit 12 is formed, and the print element boards 13 and the wiring member 15 are connected), and the liquid ejection head 1 is completed (step S74).

Due to occurrence of electrostatic discharge and connection failure or application of external force, it is possible that conduction is established between the anti-cavitation film 135 and other electrical wirings after the electric inspection of the anti-cavitation film 135 is performed before completion of the liquid ejection head 1. In order to inspect existence of the conduction and to guarantee insulation of the anti-cavitation film 135 finally, an electric inspection of the anti-cavitation film 135 is performed again in the final form in which the liquid ejection head 1 is completed (step S75).

Specifically, a voltage is applied to the connection pad 201 connected to the anti-cavitation film 135, and determination about insulation between the anti-cavitation film 135 and other electrical wirings (the wiring layers 133) is made based on a measurement value of a leakage current in the same manner as in step S72. In this case, since it is important to improve inspection accuracy and to ensure insulating guarantee even if inspection efficiency is sacrificed somewhat, the inspection of existence of the leakage current is desirably performed individually to each of other wiring layers 133. Therefore, unlike step S72, it is not necessary to apply a negative voltage to the anti-cavitation film 135 (the connection pad 201), and it is possible to perform a normal electric inspection even in a state where the protective diode 138 is connected to the anti-cavitation film 135. Since the protective diode 138 is connected to the anti-cavitation film 135 in the present embodiment, existence of a defective protective diode 138 may also be inspected in the electric inspection in this step.

Figure 8:
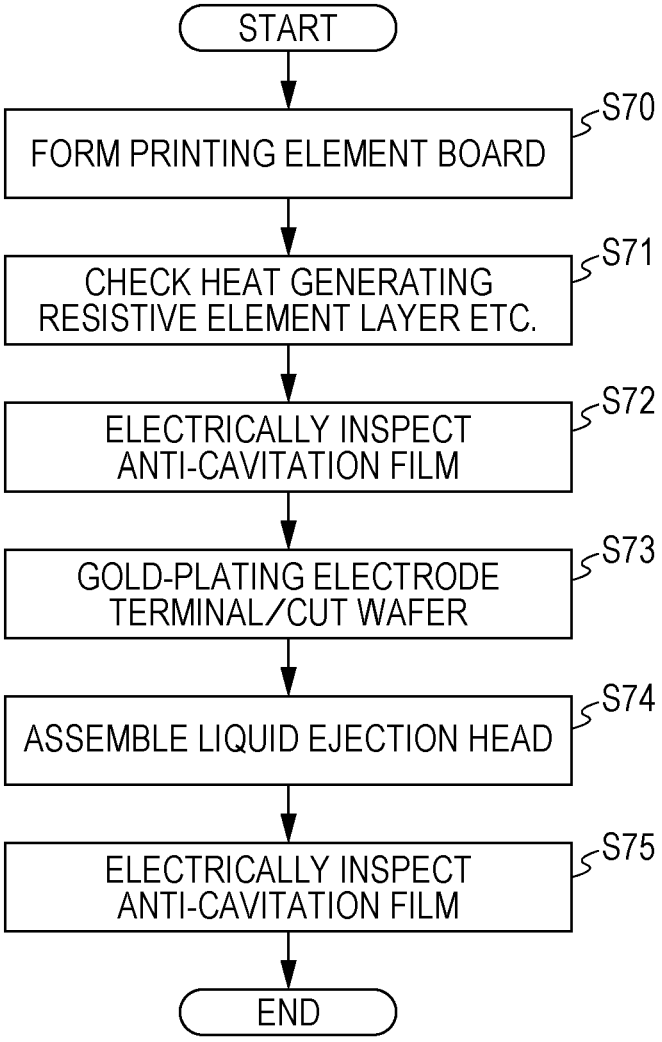
FIG. 8 is a flowchart of a method for manufacturing a liquid ejection head.

Although not illustrated in the flowchart of FIG. 8, electric inspections (on electrical conductivity, insulation, resistance values, current values, voltage values, etc.) of each wiring (e.g., a VH wiring, a GNDH wiring, and a DATA wiring) are also performed through the connection pads 201 simultaneously with the electric inspection of the anti-cavitation film 135.

As described above, according to the present disclosure, an electric inspection to inspect insulation between the anti-cavitation film and other electrical wirings can be performed in the liquid ejection head in the final form.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2016-000964, filed Jan. 6, 2016, which is hereby incorporated by reference herein in its entirety.

What is claimed is:

1. A liquid ejection head comprising:

a print element board including an energy generating element configured to generate energy used for ejection of a liquid, an electrode terminal, an electroconductive anti-cavitation film provided to cover the energy generating element, and a test pad electrically connected to the anti-cavitation film, wherein a first insulation inspection of the anti-cavitation film is performed through the test pad prior to assembly of the liquid ejection head;

a connection board including a connection pad electrically connectable from outside the liquid ejection head; and a wiring member for electrically connecting the connection board to the print element board, wherein a plated layer is formed on the print element board to electrically connect the electrode terminal and the anti-cavitation film after the first insulation inspection of the anti-cavitation film performed through the test pad, wherein after the plated layer is formed the anti-cavitation film is electrically connected to the connection pad via the wiring member, and wherein a second insulation inspection of the anti-cavitation film is performed through the connection pad after assembly of the liquid ejection head.

2. The liquid ejection head according to claim 1, wherein the print element board includes a protective diode of which anode is connected to the anti-cavitation film and cathode is connected to ground.

3. The liquid ejection head according to claim 2, wherein the protective diode is connected to the anti-cavitation film by the plated layer.

4. The liquid ejection head according to claim 1, wherein a plurality of the print element boards are provided, and the connection board includes one connection pad electrically connected to the anti-cavitation film of the plural print element boards.

5. The liquid ejection head according to claim 1, wherein a plurality of the print element boards are provided, and the connection board includes a plurality of the connection pads each of which is electrically connected to each of the anti-cavitation films of the plural print element boards, respectively.

6. The liquid ejection head according to claim 1, wherein the anti-cavitation film has a single layer structure of Ta.

7. The liquid ejection head according to claim 1, wherein the anti-cavitation film has a 3-layer structure of Ta/Ir/Ta.

8. A method for manufacturing a liquid ejection head comprising steps of:

preparing a print element board which includes an energy generating element configured to generate energy used for ejection of a liquid, an electrode terminal, an electroconductive anti-cavitation film provided to cover the energy generating element, and an electrical wiring electrically connected with the energy generating element, and a test pad electrically connected to the anti-cavitation film;

inspecting insulation between the anti-cavitation film and the electrical wiring through a test pad prior to assembly of the liquid ejection head;

preparing a connection board which includes a connection pad electrically connectable from the outside the liquid injection head;

preparing a wiring member for electrically connecting the connection board to the print element board;

forming a plated layer on the print element board to electrically connect the electrode terminal and the anti-cavitation film after the insulation inspection of the anti-cavitation film performed through the test pad, electrically connecting the connection pad and the anti-cavitation film via the wiring member and plated layer;

assembling the print element board and connection board into the liquid ejection head; and inspecting insulation between the anti-cavitation film and the electrical wiring through the connection pad.

9. The method for manufacturing a liquid ejection head according to claim 8, wherein the step of preparing the print element board includes forming a protective diode of which cathode is connected to ground in the print element board, inspecting insulation of the anti-cavitation film, and then connecting an anode of the protective diode to the anti-cavitation film.

10. The method for manufacturing a liquid ejection head according to claim 9, wherein the step of preparing the print element board includes forming a plated layer which connects the anode of the protective diode and the anti-cavitation film in the print element board.

11. The method for manufacturing a liquid ejection head according to claim 8, wherein inspection of insulation of the anti-cavitation film through the test pad is collectively performed to the electrical wiring by applying a negative voltage to the test pad.

12. The method for manufacturing a liquid ejection head according to claim 8, wherein the step of electrically connecting the connection pad includes connecting one connection pad to the anti-cavitation films of a plurality of the print element boards.

13. The method for manufacturing a liquid ejection head according to claim 8, wherein the step of electrically connecting the connection pad includes connecting a plurality of the connection pads to the anti-cavitation films of a plurality of the print element boards, respectively.

14. The method for manufacturing a liquid ejection head according to claim 8, wherein the step of preparing the print element board includes forming the anti-cavitation film which has a single layer structure of Ta in the print element board.

15. The method for manufacturing a liquid ejection head according to claim 8, wherein the step of preparing the print element board includes forming the anti-cavitation film which has a 3-layer structure of Ta/Ir/Ta in the print element board.

* * * * *